US007083445B1

(12) United States Patent
Mills et al.

(10) Patent No.: US 7,083,445 B1
(45) Date of Patent: Aug. 1, 2006

(54) CONNECTOR ASSEMBLY

(75) Inventors: Peter H. Mills, Sunrise, FL (US); David H. McClintock, Davie, FL (US); Eduardo J. Moralejo, Miami, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/121,389

(22) Filed: May 4, 2005

(51) Int. Cl.
*H01R 13/62* (2006.01)

(52) U.S. Cl. ..... 439/157

(58) Field of Classification Search ..... 439/157, 439/160, 923
See application file for complete search history.

(56) References Cited

U.S. PATENT DOCUMENTS 3,008,115 A * 11/1961 Oakes ..... 439/160
5,169,327 A * 12/1992 Hatagishi ..... 439/157
5,447,443 A * 9/1995 Ramah ..... 439/160
5,711,682 A * 1/1998 Maejima ..... 439/157
6,382,991 B1 * 5/2002 Kumakura et al. ..... 439/157

* cited by examiner

*Primary Examiner*—Tho D. Ta
(74) *Attorney, Agent, or Firm*—Barbara R. Doutre

(57) ABSTRACT

An apparatus for engaging and disengaging a first connector half (202) from a second connector half (204) includes a first ramp (206) and second ramp (216) for each connector half. The first and second ramps (206, 216) have frictional properties and geometries which cancel forces to provide for automatic separation of the ramps during connection of the two connector halves. For disconnection, the first and second ramps translate a horizontal push force (240) at the ends of the ramps into an upward motion so as to disengage the first connector half (202) from the second connector half (204).

11 Claims, 9 Drawing Sheets

—PRIOR ART—

CONNECTOR ASSEMBLY

FIELD OF THE INVENTION

The present invention relates generally to connectors and more specifically to assemblies used to facilitate the connection and disconnection of connectors.

BACKGROUND OF THE INVENTION

Many products incorporate the use of connectors to transfer input and output signals. Connectors are typically formed of two mating halves characterized by a predetermined removal force to separate the two halves. A major concern comes into play when the connection force is released and the removal force is left free to transfer to components to which the connector half is coupled. For example, a connector with 25 input/output (I/O) pins may have a removal force of 6–12 lbs. If the connector is pulled apart by hand, a load of over 12 lbs may be placed on the product's circuit board, solder joints and/or mechanical/electrical components. The problem can be further exacerbated in that many of today's connectors, for purposes of isolation, have a variety of pin layouts and spacing, such as connector 100 shown in FIG. 1. Connector 100 includes first and second connector halves 102, 104, the second connector half (male) is shown here with 22 I/O pins and 3 radio frequency (RF) pins that need to align and mate with corresponding receptacles in the first (female) half.

In order to avoid disconnecting a connector by hand, a lever, such as a screwdriver, is often used to pry apart the two connector halves. The use of a lever, however, requires the product design to accommodate a clearance around the connector thus taking up additional space. Screws 106 can be used to retain the two connector halves together, but likewise additional space may be required to accommodate the screw area. The force with which screws are tightened can also impact the functionality of the connector and components to which the connector is coupled. Furthermore, the use of screws also increases the time it takes to connect and disconnect the two connector halves.

Accordingly, there is a need for an improved connector assembly that facilitates both connection and disconnection capabilities.

BRIEF DESCRIPTION OF THE FIGURES

A preferred embodiment of the invention is now described, by way of example only, with reference to the accompanying figures in which.

DETAILED DESCRIPTION OF THE PREFERRED EMBODIMENTS

Briefly in accordance with the present invention, there is provided herein a set of ramps that facilitate the engagement and disengagement of a connector having first and second connector halves. In accordance with the present invention, upon mating of the two connector halves, the frictional properties and geometries of the ramps allow insertion forces to translate horizontally, thus providing auto-separation of the ramps. The auto-separation of the ramps thus facilitates engagement of the connector halves. Upon disengagement, the frictional properties and geometries allow a horizontal push force applied to the ramps to be translated into an upward motion so as to disengage the first connector half from the second connector half. The frictional properties and geometries of the ramps allow the push force to stop upon disengagement of the first and second connector halves.

Figure 1:
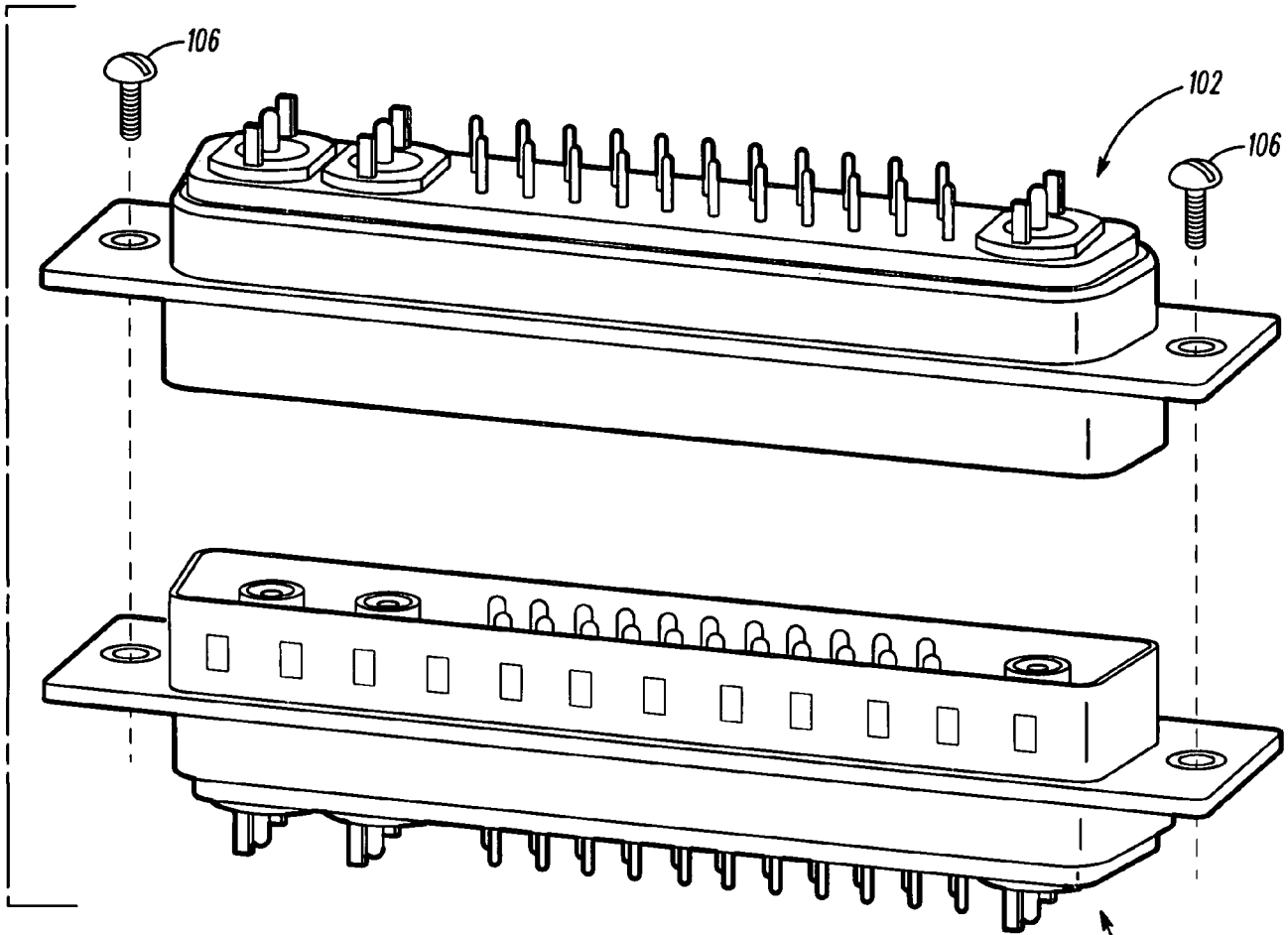
FIG. 1 shows a standard two part connector known in the art.
Figure 2:
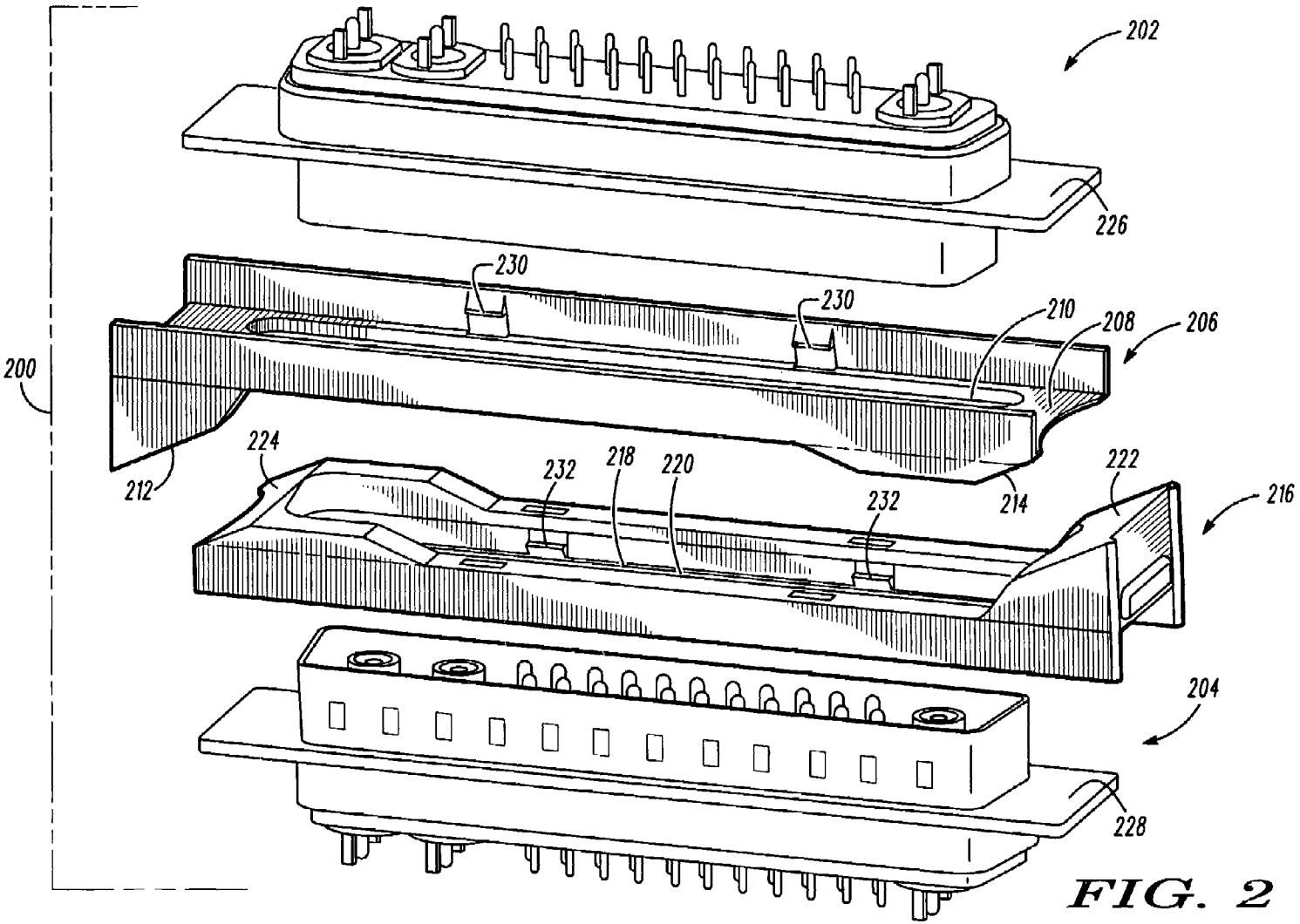
FIG. 2 illustrates an exploded view of a connector assembly in accordance with the present invention.
Figure 3:
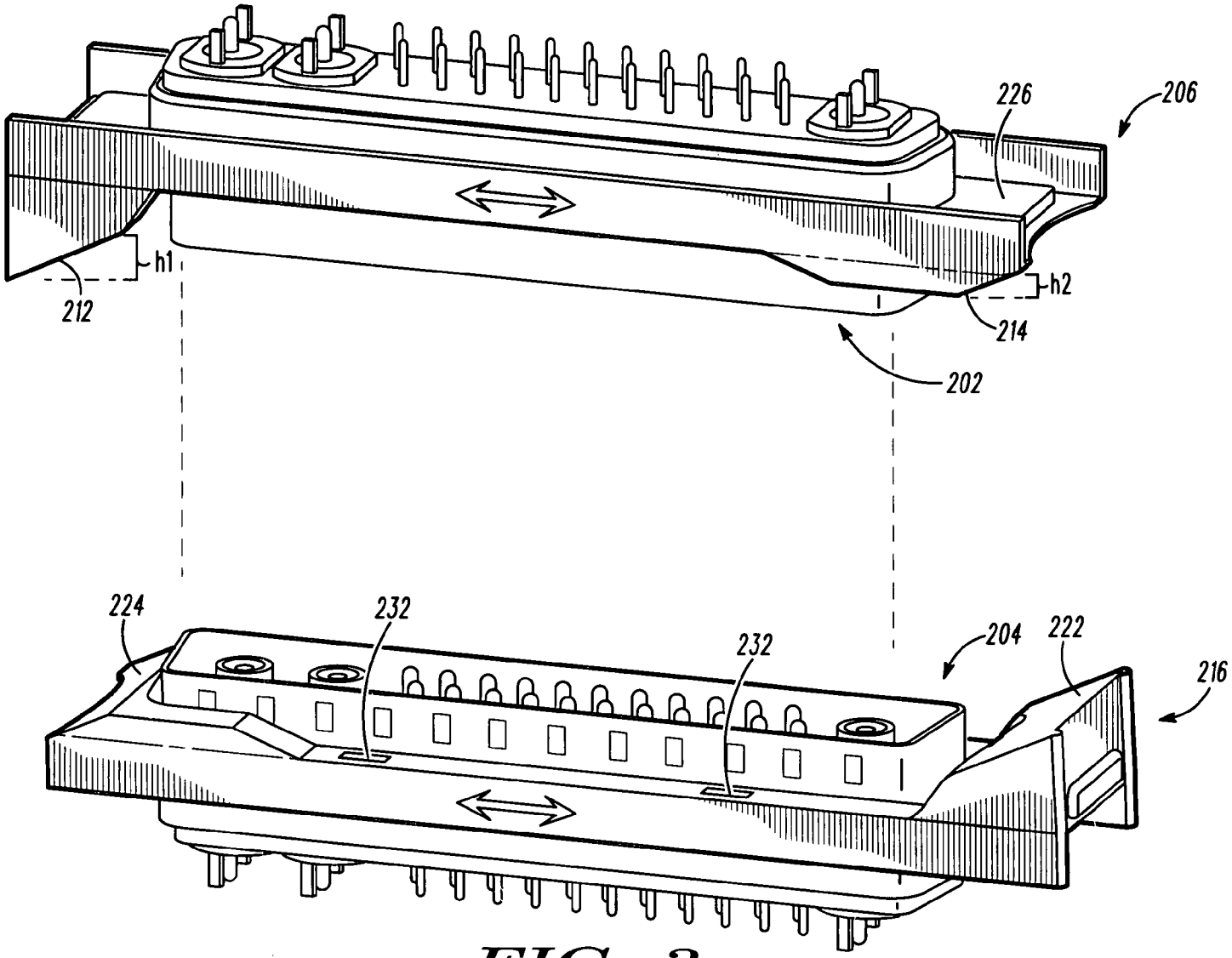
FIG. 3 illustrates a partially assembled view of the connector assembly of FIG. 2 in which each connector ramp slides relative to each connector half in accordance with the present invention.

Referring now to FIG. 2, there is shown an exploded view of a connector assembly in accordance with the present invention. Assembly 200 provides an apparatus for engaging and disengaging a two part connector having a first connector half 202 and a second connector half 204. Assembly 200 includes a first ramp 206 having a horizontal plane 208 with an aperture 210 formed therein between first and sloped second ends 212, 214. In accordance with the present invention and as illustrated in FIG. 3, the first connector half 202 is coupled within the aperture 210 such that the first ramp 206 slides back and forth about the first connector half. The first sloped end 212 preferably extends higher (h1) than the second sloped end 214, and the angle of slope 212 is the same as the angle of slope 214. The slideable coupling is preferably achieved through the use of retention tabs 230 formed as part of the first ramp 206 for retaining a flange/collar 226 of the first connector half 202. The first ramp 206 can thus slide back and forth along the flange 226 prior to the first connector half 202 being mated with second connector half 204.

In accordance with the present invention and referring back to FIG. 2, assembly 200 further comprises a second ramp 216 having a horizontal plane 218 with an aperture 220 formed therein between first and second sloped ends 222, 224. In accordance with the present invention and as illustrated in FIG. 3, the second connector half 204 is coupled within the aperture 220 such that the second ramp 216 slides back and forth about the second connector half. The first sloped end 222 preferably extends higher than the second sloped end 224. The slideable coupling is preferably achieved through the use of retention tabs 232 formed as part of the second ramp 216 for retaining a flange/collar 228 of the second connector half 204. The second ramp 216 can thus slide back and forth along the flange 228 prior to the second connector half 204 being mated with first connector half 202.

In accordance with the present invention, the first sloped end 212 of the first ramp 206 is symmetrical to the first sloped end 222 of the second ramp 216. The second sloped end 214 of the first ramp 206 is symmetrical to the second sloped end 224 of the second ramp 216. The first ramp 206, having first connector half 202 coupled therein, aligns with the second ramp 216, having second connector half 204 coupled therein, such that the sloped ends 212, 214 of the first ramp are mirror imaged and rotated with respect to the sloped ends 222, 224 of the second ramp. The ramps 206, 216 can be keyed, if desired, to facilitate orientation during assembly of the connectors.

Figure 4:
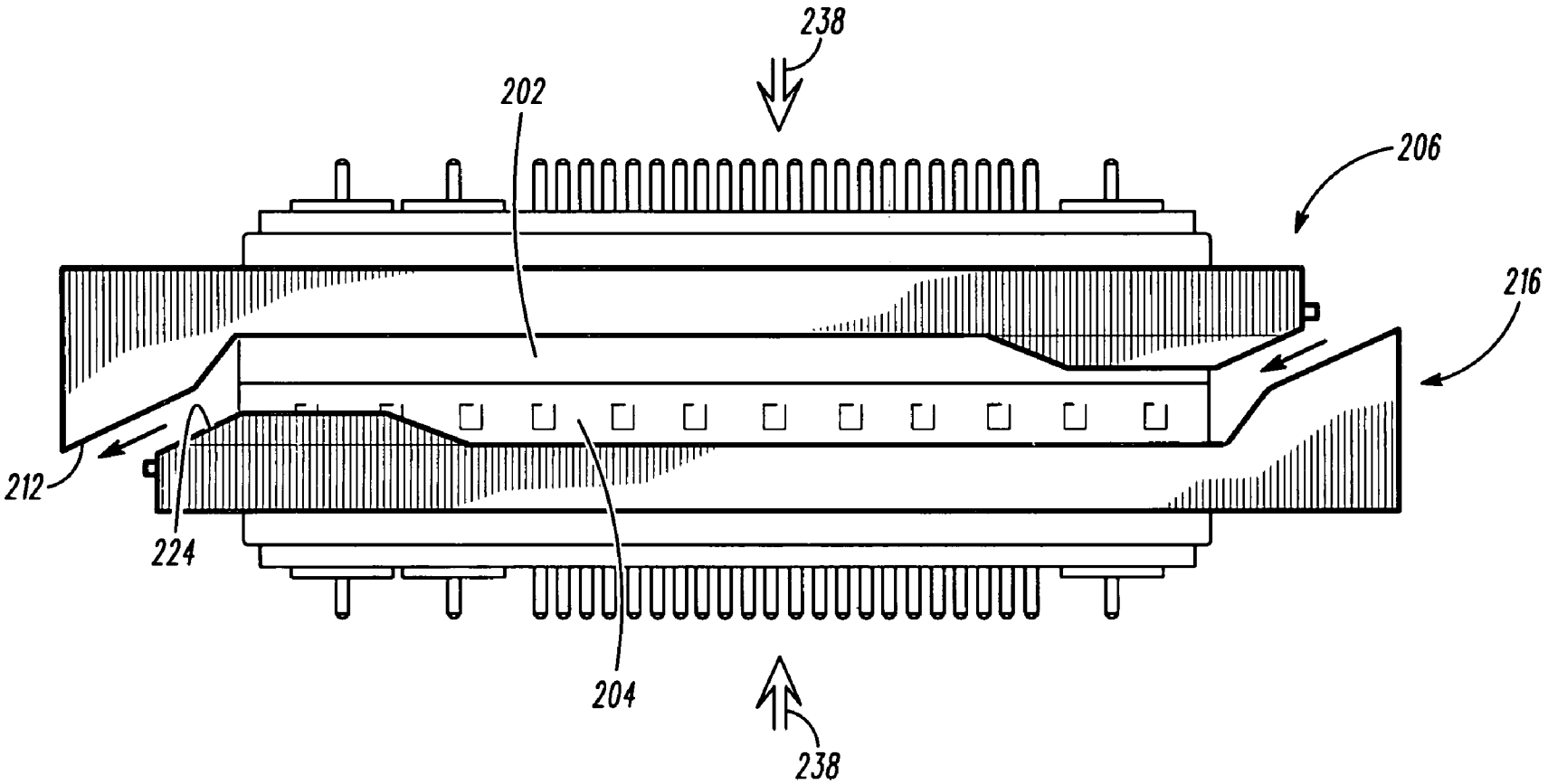
FIG. 4 illustrates the connector assembly of FIG. 3 aligned prior to engagement of the two connecter halves.

Aligning the two connector halves 202, 204 prior to engagement as shown in FIG. 4, the first sloped end 212 of the first ramp 206 aligns with the second sloped end 224 of the second ramp 216, and the second sloped end 214 of the first ramp 206 aligns with the first sloped end 222 of the second ramp 216. At this stage of assembly, the ramps 206, 216 can still slide individually back and forth about each connector half 202, 204. As will be discussed in more detail later, the frictional properties and geometries of the ramps 206, 216 are selected to allow insertion forces (represented by designator 238) to translate horizontally upon insertion of the two connector halves 202, 204, thus providing auto-separation of the ramps come together. The advantage to auto-separation during insertion is that it allows the ramps to be in any position prior to assembly and still allow the two connector halves 202, 204 to mate.

Figure 5:
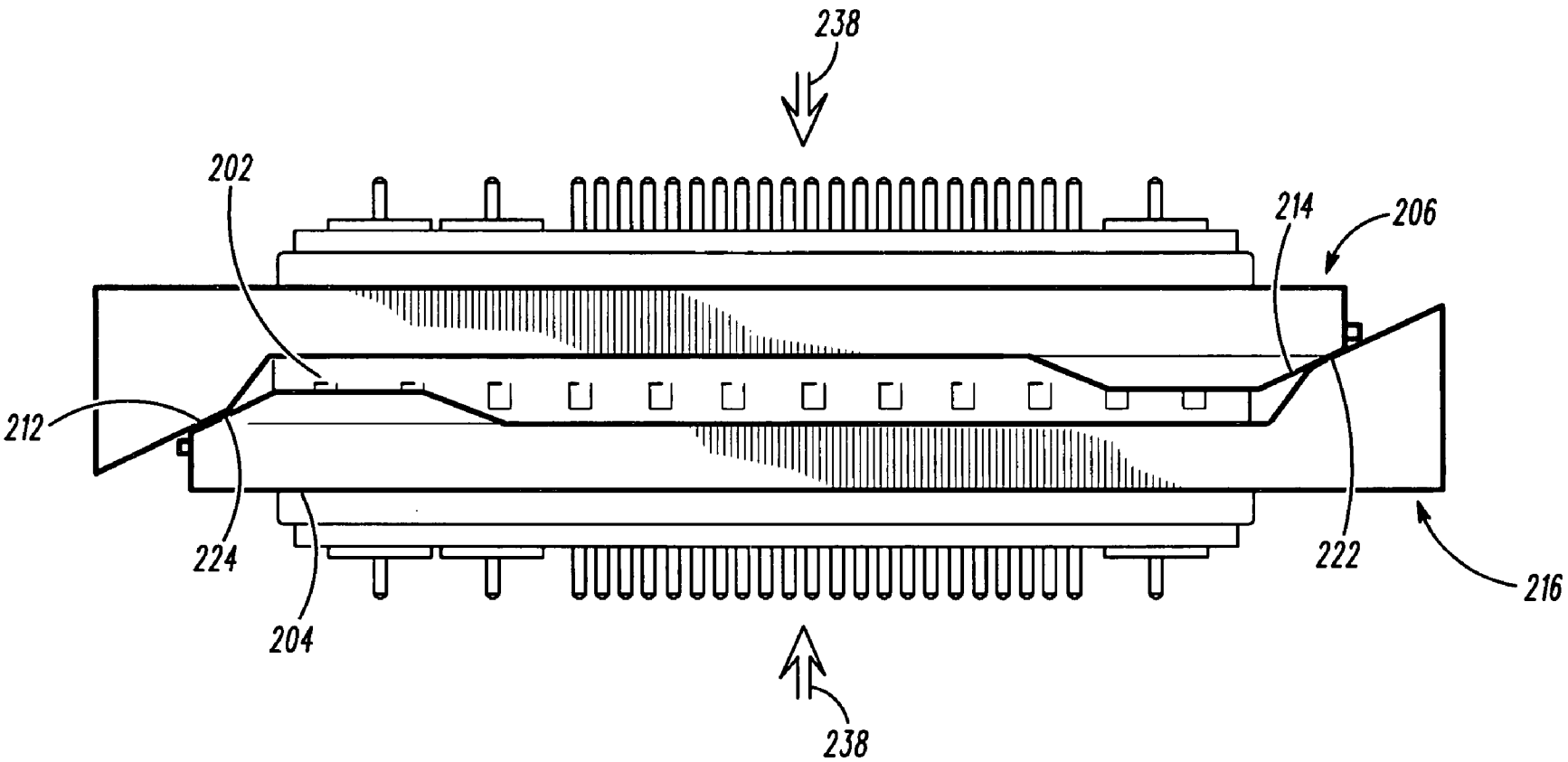
FIG. 5 illustrates the connector assembly of FIG. 4 upon complete engagement of the two connecter halves.

Upon complete engagement and as shown in FIG. 5, the first and second connector halves 202, 204 mate to complete the connection. Using a predetermined insertion force represented by designator 238, the two connector halves 202, 204 mate together such that the higher sloped end 212 of the first ramp 206 slides relative to the lower sloped end 224 of the second ramp 216, and the lower sloped end 214 of the first ramp 206 slides relative to the higher sloped end 222 of the second ramp 216, thereby finishing the assembly. The motion of the ramps is now limited by the sides of the completed connector.

Figure 6:
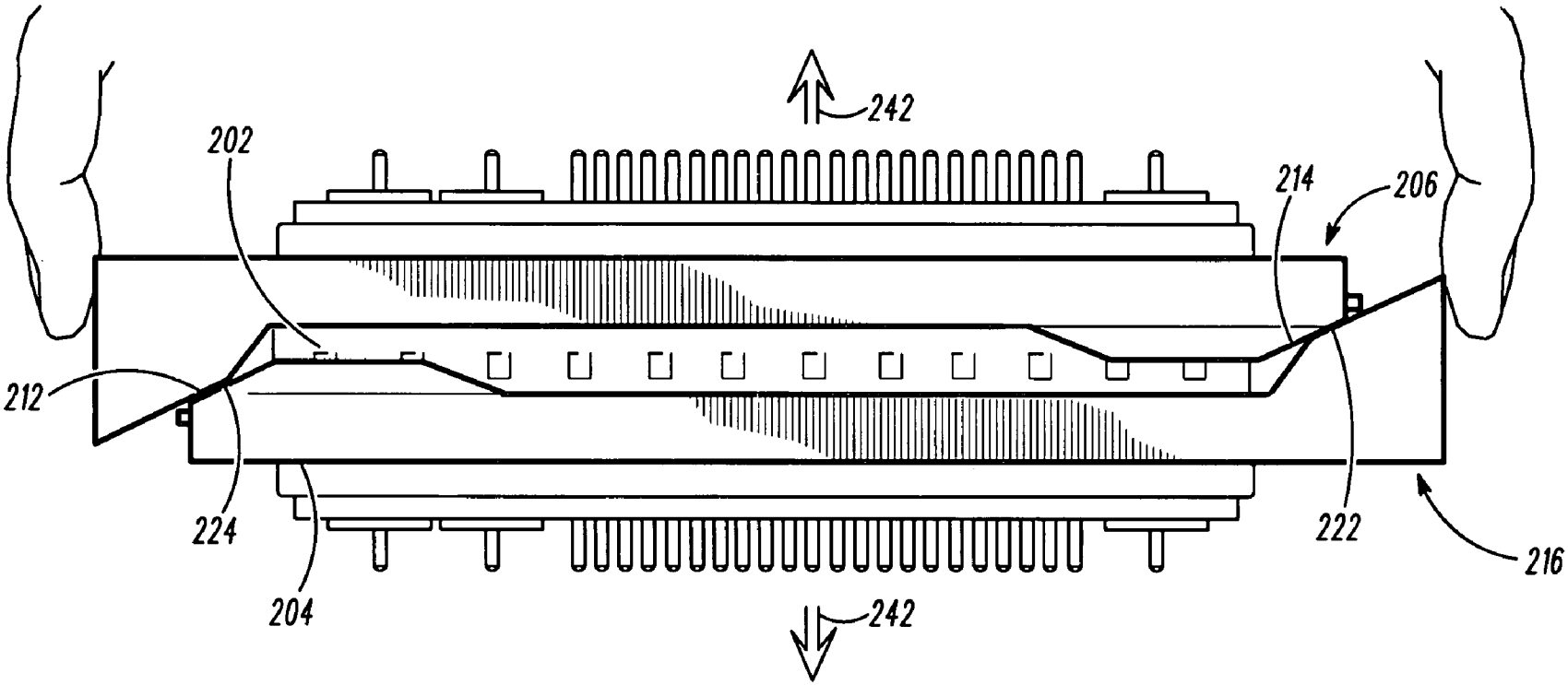
FIG. 6 illustrates the connector assembly of FIG. 4 with horizontal forces applied in accordance with the present invention
Figure 7:
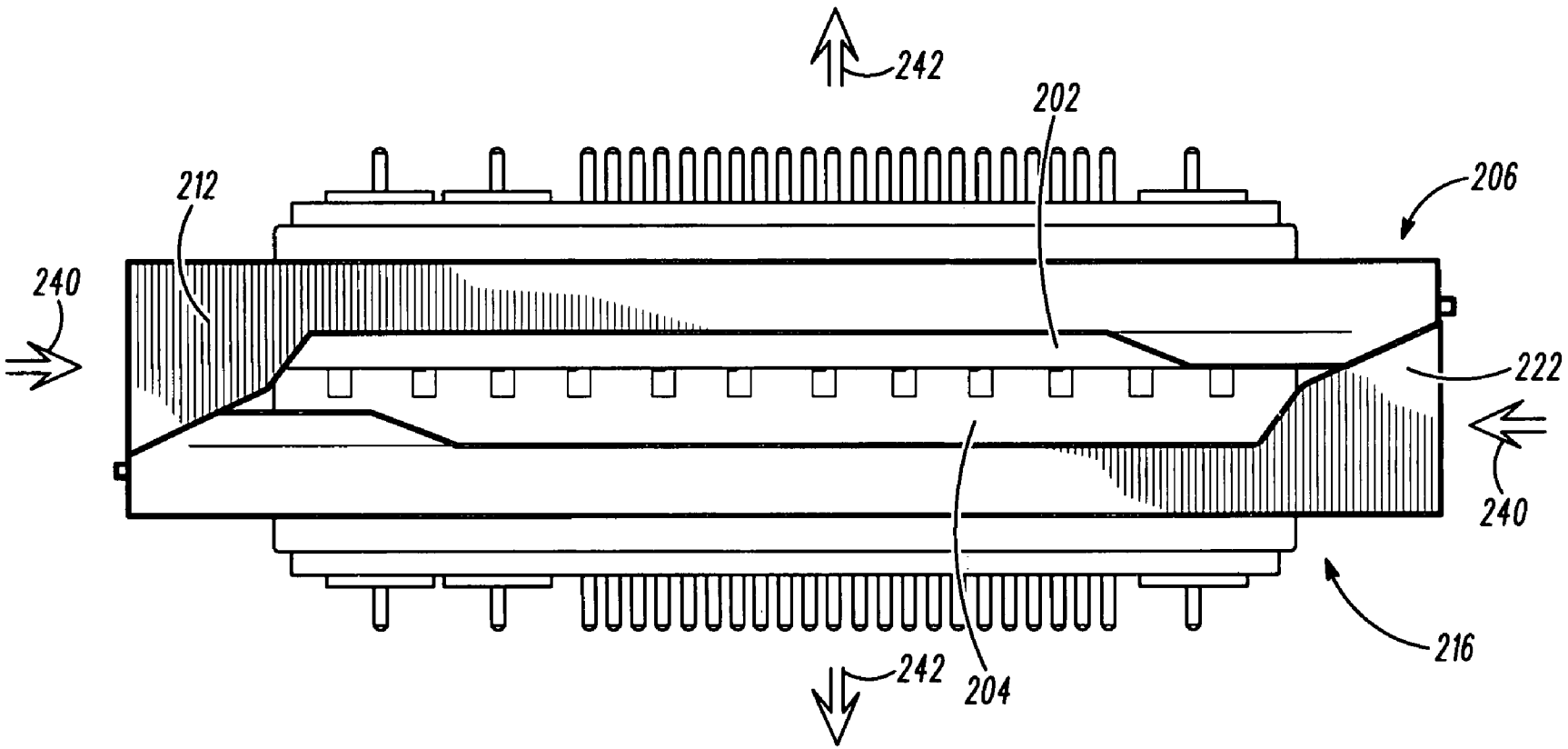
FIG. 7 illustrates disengagement of the connector ramps in accordance with the present invention.

In accordance with the present invention and as shown in FIGS. 6 and 7, the connector is disengaged by applying a horizontal force 240 to the higher sloped ends 212, 222 of the first and second ramps 206, 216. The first and second ramps 206, 216 formed in accordance with the present invention translate the horizontal push force 240 into an upward motion 242 to separate the first and second connector halves 202, 204. The maximum excursion of the separation is limited by the height of each ramp. The horizontal push force 240 is applied by pressing, squeezing or pinching the higher sloped ends 212, 222 towards each other. All of these are simple natural motions which the user can perform without the use of any tools. Thus, the upward motion 242 is controlled which protects components on any adjoining sub-assembly (not shown) from damage during separation.

Figure 8:
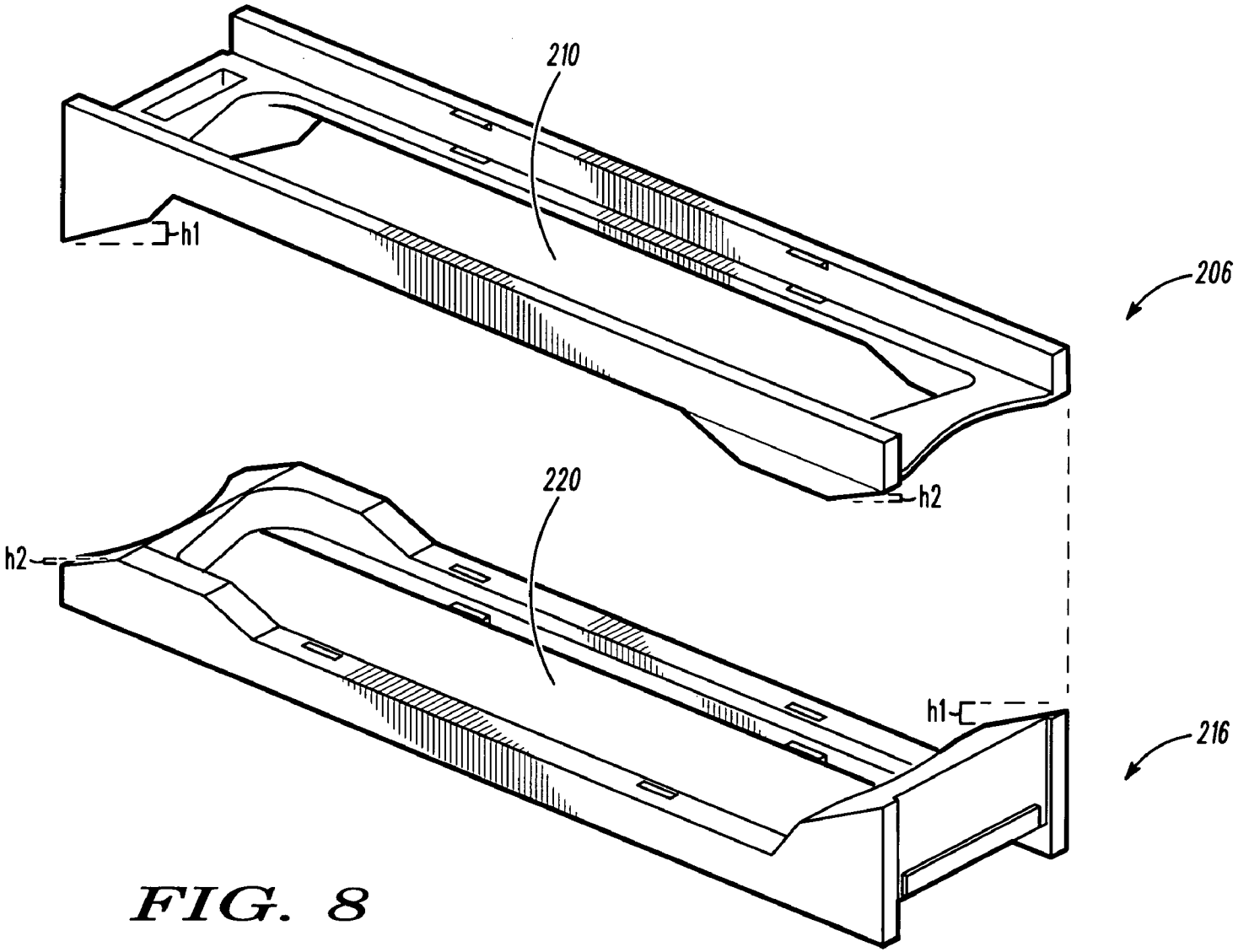
FIG. 8 shows two connector ramps formed in accordance with the present invention.

FIG. 8 illustrates the two connector ramps 206, 216 formed in accordance with the present invention. The apertures 210, 220 and ramp heights h1, h2 can be seen in this view.

Figure 9:
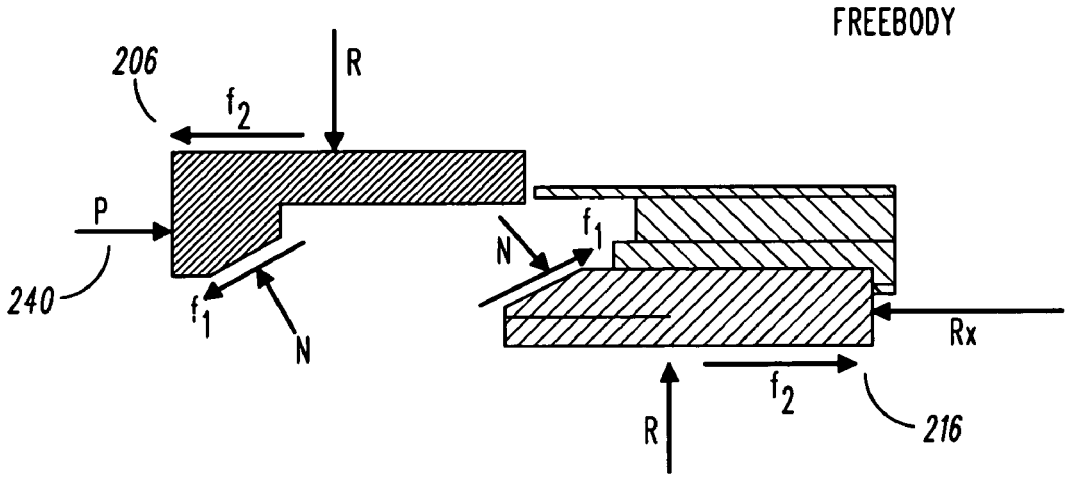
FIGS. 9 and 10 illustrate ramp to ramp removal and engagement forces in accordance with the present invention.

FIG. 9 illustrates ramp to ramp removal and engagement forces characterizing ramps formed in accordance with the present invention. The material used for the ramps 206, 216 may vary but is preferably selected to minimize frictional forces (f1, f2). Examples of static removal force, dynamic removal force and insertion force are calculated for a given material based on the following:

μ=Coefficient of friction
N=Normal force to the friction
θ=Angle of contact
f=Frictional force
R=Reactionary force (Force Pressing Down)
P=Applied force As an example, the coefficients of friction for a selected polymer material are given in the following Table:

| Coefficient of Friction (μ) | | |
|---|---|---|
| Material | Static | Dynamic |
| Polymer to polymer | 0.19 | 0.15 |
| Polymer to steel | 0.14 | 0.21 |

Figure 10:
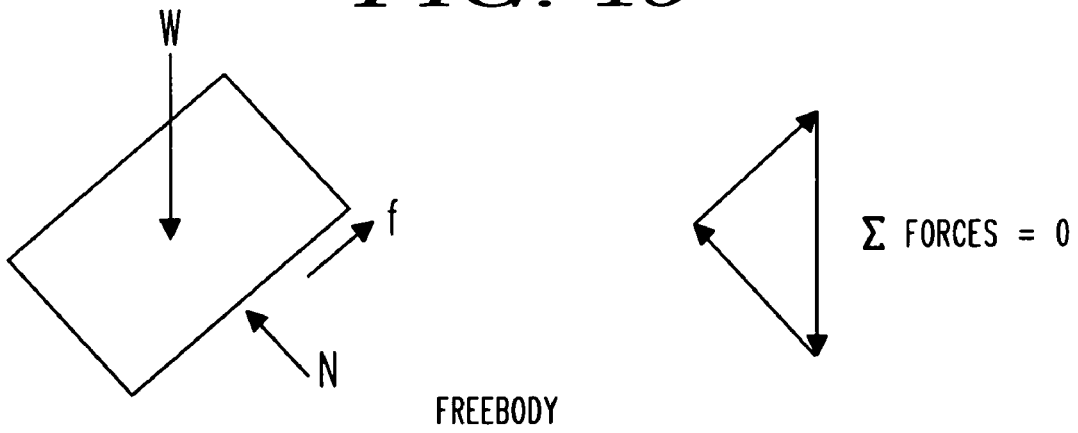

Static Removal Force
f=μN
f1=0.19N
f2=0.14R=0.9534 lbs
R=6.81 lbs
Angle (θ)=25 degrees
$\Sigma Fx=0$: $P-f2-f1*\cos(\theta)-N*\sin(\theta)=0$
$P-0.95-0.19*N*\cos(25)-N*\sin(25)=0$
$P=0.95+0.59*N$
$\Sigma Fy=0$: $R-N*\cos(\theta)+f1*\sin(\theta)=0$
$6.81-N*\cos(25)+0.19*N*\sin(25)=0$
$6.81=0.83*N$
N=8.24 lbs
Substitute for P=
$P=0.95+0.59*8.24$
P=5.81 lbs Dynamic Removal Force
f=μN
f1=0.15N
f2=0.21R=1.4301
R=6.81 lbs
Angle (θ)=25 degrees
$\Sigma Fx=0$: $P-f2-f1*\cos(\theta)-N*\sin(\theta)=0$
$P-1.43-0.15*N*\cos(25)-N*\sin(25)=P=1.43+0.56*N$
$\Sigma Fy=0$: $R-N*\cos(\theta)+f1*\sin(\theta)=0$
$6.81-N*\cos(25)+0.15*N*\sin(25)=0$
$6.81=0.97*N$
N=7.02 lbs
Solving for P
$P=1.43+0.56*7.02$
P=5.36 lbs Referring to FIG. 10, the following provides an example of a coefficient of friction to allow the first Ramp to automatically separate from the second ramp.
W=Weight
m=Mass
g=Gravity
W=mg
From the free body diagram
$N=W*\cos(\theta)$
$f=\mu N=W*\sin(\theta)$
Solving for the critical coefficient of friction
$\mu=(W*\sin(\theta))/(W*\cos(\theta))$
$\mu=\tan(\theta)$
Solve for μ
$\mu=\tan(25)=0.47$ According to the calculation for the critical coefficient of friction presented above, as long as the coefficient of friction (COF) is below 0.47 the ramps will slide with no force applied. The largest COF for the selected polymer material occurs in motion, where the COF is 0.21; therefore the ramps will slide apart from each other with no force applied.

Again, materials are preferably selected such that frictional properties (f1, f2) and geometries (angle θ) of the ramps 206, 216 allow forces to cancel upon insertion of the two connector halves 202, 204 thus providing auto-separation of the ramps as they come together. The advantage to auto-separation during insertion is that it allows the ramps to be in any position prior to assembly and still allow the two connector halves 202, 204 (male/female) to mate.

The geometries and material selected for the ramps can be varied depending on the insertion/removal forces associated with the connector as well as pin layout and space constraints within the product. The ramps 206, 216 preferably remain attached to each respective connector half 202, 204. The retention of the ramps can be accomplished in several ways such as a molded groove, teeth or tabs as previously discussed to facilitate interchange-ability between sub-assemblies. The ramps can be keyed, if desired, to facilitate orientation during assembly of the connectors.

By forming a ramp having a ramp geometry of a horizontal plane with an aperture formed between first and second sloped ends, one sloped end extending higher than the other, there has been provided a removal apparatus for a connector half of a two part connector. The ramp formed in accordance with the present invention allows for the automatic disengagement of one connector half from another.

While the invention has been described in conjunction with specific embodiments thereof, additional advantages and modifications will readily occur to those skilled in the art. The invention, in its broader aspects, is therefore not limited to the specific details, representative apparatus, and illustrative examples shown and described. Various alterations, modifications and variations will be apparent to those skilled in the art in light of the foregoing description. Thus, it should be understood that the invention is not limited by the foregoing description, but embraces all such alterations, modifications and variations in accordance with the spirit and scope of the appended claims.

We claim:

1. A connector assembly, comprising:

a first connector half;

a second connector half;

a first ramp coupled to the first connector half, the first ramp having an aperture formed therein for receiving the first connector half, the first aperture formed so as to allow the first ramp to slide back and forth about the first connector half, the first ramp having a first sloped end and a second sloped end;

a second ramp coupled to the second connector half, the second ramp having an aperture formed therein for receiving the second connector half, the second aperture formed so as to allow the second ramp to slide back and forth about the second connector half, the second ramp having a first sloped end and a second sloped end;

the first sloped end of the first ramp device aligning to the second sloped end of the second ramp device, the second sloped end of the first ramp device aligning to the first sloped end of the second ramp device; and the first and second connector halves disengaging in response to a horizontal push force being applied the first sloped end of the first ramp and the first sloped end of the second ramp.

2. The connector assembly of claim 1, wherein the first and second ramps translate the horizontal push force into an upward motion so as to disengage the first connector half from the second connector half.

3. The connector assembly of claim 1, wherein the horizontal push force is applied by pinching the first sloped end of the first ramp and the first sloped end of the second ramp.

4. The connector assembly of claim 1, wherein for connector separation, the first and second ramps translate a symmetrical push force into upward motion, the maximum excursion of which is limited by the height of the each ramp.

5. The connector assembly of claim 1, wherein the first and second ramps have frictional properties and geometries to allow automatic separation of the first and second ramps during engagement of the first and second connector halves and automatic disengagement of the connector halves upon a horizontal push force to the first and second ramps.

6. The connector assembly of claim 1, wherein the first and second ramps are keyed.

7. The connector assembly of claim 1, wherein frictional properties and geometries of the first and second ramps allow insertion forces to cancel upon mating the two connector halves.

8. An apparatus for engaging and disengaging a two part connector, comprising:

a first ramp having a horizontal plane with an aperture formed therein between first and sloped second ends, the first sloped end extending higher than the second sloped end, a first connector half coupled within the aperture between the first and second sloped ends;

a second ramp having a horizontal plane with an aperture formed therein between first and sloped second ends, the first sloped end extending higher than the second sloped end, a second connector half coupled within the aperture between the first and second sloped ends;

upon alignment of the first and second connector halves, the higher sloped end of the first ramp sliding relative to the lower sloped end of the second ramp, and the lower sloped end of the first ramp sliding relative to the higher sloped end of the second ramp;

upon mating of the two connector halves, movement of the first and second ramps being limited by sidewalls of the mated connector; and the connector being disengaged by applying a horizontal force to the higher sloped ends of the first and second ramps.

9. The apparatus of claim 8, wherein the first and second ramps translate the horizontal force into an upward motion to separate the first and second connector halves.

10. The apparatus of claim 9, wherein the horizontal force is applied by pressing the higher sloped ends.

11. A connector assembly, comprising:

a first ramp for receiving a first connector half;

a second ramp for receiving a second connector half; and the first and second ramps having frictional properties and geometries to allow automatic separation during engagement of the first and second connector halves, wherein the frictional properties and geometries of the first and second ramps translate a horizontal push force on the first and second ramps into an upward motion so as to disengage the first connector half from the second connector half.

* * * * *